US011353239B2

(12) United States Patent
Bouche et al.

(10) Patent No.: US 11,353,239 B2
(45) Date of Patent: Jun. 7, 2022

(54) SOUND REDUCTION GRILLE ASSEMBLY

(71) Applicant: Broan-NuTone LLC, Hartford, WI (US)

(72) Inventors: Patrick Bouche, Sherbrooke (CA); Raymond Panneton, Sherbrooke (CA); Brent Lillesand, Milwaukee, WI (US); Jean-Bernard Piaud, Drummondville (CA); Rick Sinur, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 460 days.

(21) Appl. No.: 16/553,456

(22) Filed: Aug. 28, 2019

(65) Prior Publication Data

US 2021/0063048 A1 Mar. 4, 2021

(51) Int. Cl.
*F24F 13/24* (2006.01)
*G10K 11/162* (2006.01)

(52) U.S. Cl.
CPC ..... *F24F 13/24* (2013.01); *G10K 11/162* (2013.01); *F24F 2013/242* (2013.01)

(58) Field of Classification Search
CPC ..... G10K 11/162; F24F 2013/242
See application file for complete search history.

(56) References Cited

U.S. PATENT DOCUMENTS 6,023,938 A * 2/2000 Taras ..... F24F 13/24 62/296
6,217,281 B1 * 4/2001 Jeng ..... F04D 29/664 415/119
8,123,468 B2 * 2/2012 Shirahama ..... F04D 29/4213 415/119
8,146,707 B2 * 4/2012 Choi ..... F24F 1/0047 181/225
9,305,539 B2 * 4/2016 Lind ..... G10K 11/161
9,641,043 B1 * 5/2017 Leedy ..... E06B 7/084
10,087,954 B2 * 10/2018 Wang ..... F04D 29/664
10,323,655 B2 * 6/2019 Arima ..... F04D 29/522
11,204,204 B2 * 12/2021 Lee ..... F28F 3/04
2005/0045416 A1 * 3/2005 McCarty ..... F01K 9/04 181/224
2010/0175411 A1 * 7/2010 Choi ..... F24F 1/0047 62/296

(Continued)

FOREIGN PATENT DOCUMENTS

CN 105765139 B * 11/2018 ..... G10K 11/172
GB 2510900 A * 8/2014 ..... F24F 3/24
JP WO-2005073640 A1 * 8/2005 ..... F24F 3/02

OTHER PUBLICATIONS

"Design of radial sonic crystal for sound attenuation from divergent sound source," Gupta, et al., Elsevier—Wave Motion 55 (2015) (9 pages).

(Continued)

*Primary Examiner* — Forrest M Phillips
(74) *Attorney, Agent, or Firm* — Barnes & Thornburg LLP

(57) ABSTRACT

A ventilation assembly and methods of forming the same includes a ventilation grille having reducing acoustic bodies configured to attenuate sound of the ventilation assembly. Arrangement of the acoustic bodies can form phononic crystal to attenuate sound and can be tuned to desired sound bands to reduce sounds.

30 Claims, 10 Drawing Sheets

(56) References Cited

U.S. PATENT DOCUMENTS

| | | | | |
|---|---|---|---|---|
| 2017/0030595 | A1* | 2/2017 | Choi | F24F 13/24 |
| 2022/0018552 | A1* | 1/2022 | Karamanos | F24F 13/20 |

OTHER PUBLICATIONS

"Acoustic resonances in two-dimensional radial sonic crystal shells," Torrent et al., New Journal of Physics, Jul. 27, 2010 (20 pages).
"Radial Wave Crystals: Radially Periodic Structures from Anisotropic Metamaterials for Engineering Acoustic or Electromagnetic Waves," Torrent et al., Physical Review Letters, Aug. 7, 2009 (5 pages).

* cited by examiner

SOUND REDUCTION GRILLE ASSEMBLY

TECHNICAL FIELD

The present disclosure relates to devices, systems, and methods for sound reducing grilles. More particularly, but not exclusively, the present disclosure relates to devices, systems, and methods for grilles for use in ventilation of enclosed rooms.

BACKGROUND

Ventilation is commonly applied to maintain desirable air conditions within confined spaces. For example, common households may include ventilation devices and/or systems for rooms having sinks or bath fixtures that use water to remove excess humidity, noxious odors or other pollutants from the room. Ventilation can require moving parts to draw air which can create vibrations and/or sound, yet, reducing excess vibration and/or sound can require costly upgrades to component parts. Accordingly, there is a need for improved ventilation with reduced vibrations and/or sound.

SUMMARY

In accordance with an aspect of the present disclosure, a ventilation assembly may comprise a main housing defining an inlet through which air can be received into the main housing and an outlet through which air can exit the main housing, a blower situated in the main housing and operable to generate a flow of air, and a grille comprising phononic crystals configured to be located adjacent to the main housing inlet.

A ventilation assembly is disclosed comprising a main housing defining an inlet through which air can be received into the main housing and defining an outlet; a blower in the main housing and operable to generate a flow of air; and a grille configured to be located adjacent to the main housing inlet, the grille having a means for reducing sound. The means for reducing sound can comprise a plurality of acoustic fixtures arranged about a grille outlet aperture defined in the grille. Adjacent acoustic fixtures can define air flow pathways in fluid communication with the grille outlet aperture. Each of the acoustic fixtures can comprise two or more acoustic bodies radially spaced apart from each other. The outer perimeter of each of the acoustic bodies can define smooth aerodynamic shape. The outer perimeter of each of the acoustic bodies can define a radial length, and each of the acoustic bodies of at least one of the acoustic fixtures can have equal radial length. The acoustic bodies of each acoustic fixture can comprise an outer acoustic body and an inner acoustic body. The outer acoustic bodies can be arranged annularly about the grille outlet aperture. The inner acoustic bodies can be arranged annularly about the grille outlet aperture. The inner and outer acoustic bodies of each acoustic fixture can be arranged with corresponding circumferential position about the grille outlet aperture. The grille can comprise a first plate defining the grille outlet aperture and the plurality of acoustic fixtures can extend from the first plate. The acoustic fixtures can each include at least two acoustic bodies situated to form a phononic crystal to attenuate sound. The phononic crystals can be collectively configured to attenuate sound within the frequency bands of the ventilation assembly. The phononic crystals can collectively be configured to attenuate sound within the frequency bands within the range of 160 to 6,300 Hz ⅓ octave band center. The phononic crystals can collectively be configured to attenuate sound within one or more frequency bands within the range of 160 to 6,300 Hz. The phononic crystals can collectively be configured to attenuate sound within one or more frequency bands within the range of 20 Hz to 20 kHz.

Another ventilation assembly is disclosed comprising a main housing defining an inlet through which air can be received into the main housing and defining an outlet; a blower situated in the main housing and operable to generate a flow of air; and a grille configured to be located adjacent to the inlet of the main housing, the grille comprising a first plate defining a grille outlet aperture; a second plate spaced from the first plate; a plurality of acoustic bodies arranged about the grille outlet aperture, each acoustic body extending from one of the first plate and the second plate. The acoustic bodies can form at least one acoustic fixture. At least one of the acoustic bodies can extend between the first and second plate. At least one of the acoustic bodies can extend between the first and second plate and connect to both the first and second plate. Adjacent acoustic bodies can define air flow pathways in fluid communication with the grille outlet aperture. The acoustic bodies can comprise two or more acoustic bodies radially spaced apart from each other. The outer perimeter of each of the acoustic bodies can define a radial length, and each of the acoustic bodies of at least one of the acoustic fixtures can have equal radial length. The acoustic bodies can comprise a plurality of outer acoustic bodies and a plurality of inner acoustic bodies. The outer acoustic bodies can be arranged annularly about the grille outlet aperture. The inner acoustic bodies can be arranged annularly about the grille outlet aperture. The outer acoustic bodies and the inner acoustic bodies can define at least one phononic crystal to attenuate sound. The phononic crystals can collectively be configured to attenuate sound within the frequency bands of the ventilation assembly. At least one of the plurality of acoustic bodies can approximate an ellipse.

A ventilation grille is disclosed comprising a first plate defining a grille outlet aperture; and a plurality of acoustic fixtures extending from the first plate and arranged about the grille outlet aperture, each of acoustic fixtures comprising at least two acoustic bodies defining at least one phononic crystal to attenuate sound.

The foregoing and other features of the present disclosure will become more apparent upon reading of the following non-restrictive description of examples of implementation thereof, given by way of illustration only with reference to the accompanying drawings.

BRIEF DESCRIPTION OF THE DRAWINGS

In the appended drawings, where like reference numerals denote like elements throughout and in where.

DETAILED DESCRIPTION

Ventilation assemblies, such as ventilation fan assemblies, are often used to ventilate rooms (e.g. bathrooms and kitchens) in residential, commercial, and industrial structures. Bathroom ventilation fan assemblies are often installed in a cutout or cavity formed in a support member, such as bathroom ceiling or wall. Traditional ventilation fan assemblies may include grilles or other air inlet openings through which the fan can draw air from the room while obstructing direct view of the fan assembly.

Figure 1:
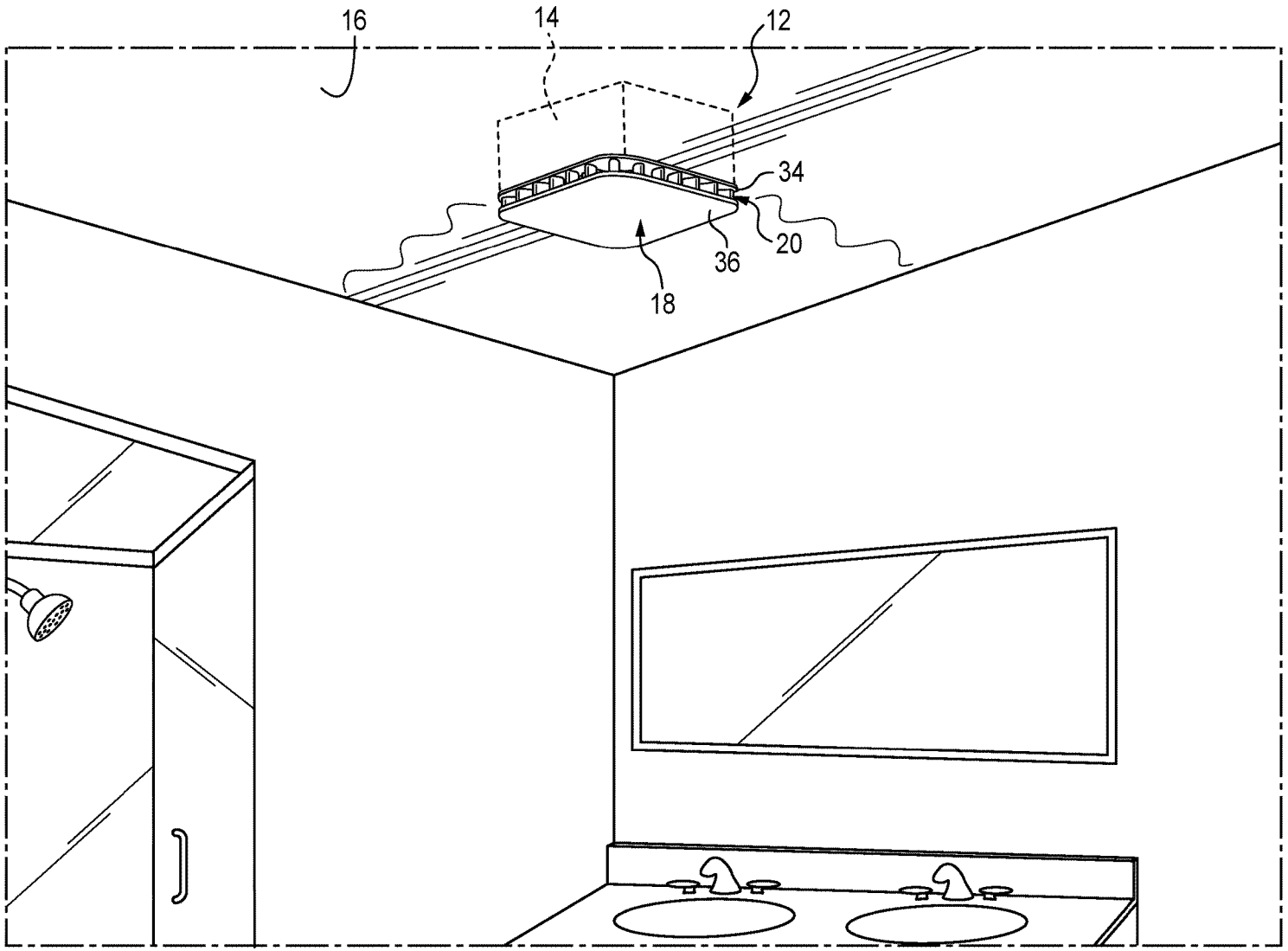
FIG. 1 is a perspective view of a non-restrictive illustrative embodiment of a ventilation assembly consistent with the present disclosure showing the ventilation assembly installed within a bathroom.

Referring to FIG. 1, an illustrative ventilation assembly 12 is shown installed within the ceiling of a bathroom. The ventilation assembly 12 includes a main housing 14 (as indicated in broken line in FIG. 1) located above the surface 16 of the ceiling and grille 18 for receiving air from the room, the grille 18 shown positioned in close proximity with the surface 16 of the ceiling and adjacent to an inlet 28 defined by the main housing 14. As discussed in additional detail below, the grille 18 include acoustic bodies 40 which can reduce the sound resulting from operation of the ventilation assembly 12.

Figure 2:
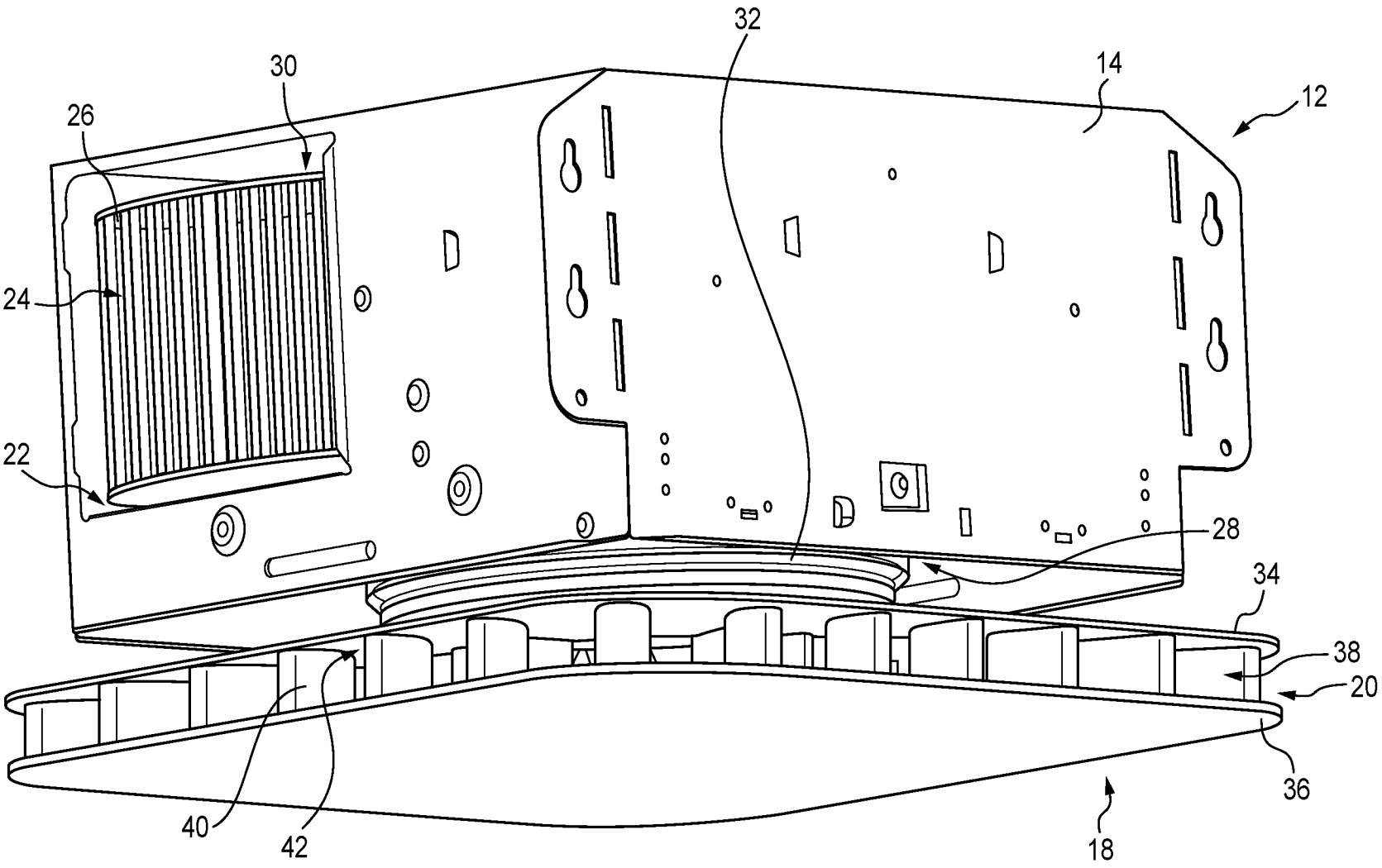
FIG. 2 is perspective view of the ventilation assembly of FIG. 1 in isolation.

Referring now to FIG. 2, the main housing 14 defines an inner cavity 22 which houses a blower assembly 24. The blower assembly 24 includes a fan 26 operable by a motor to draw air from the adjacent room through the grille 18, through the inlet 28 (via the optional adaptor ring 32 discussed below) into the inner cavity 22 of the main housing 14 and out through an exhaust 30. The main housing 14 is illustratively shown as a square box, but in some embodiments may have any suitable arrangement including any suitable shape and/or size.

The grille 18 is illustratively arranged adjacent the inlet 28 of the main housing 14. The grille 18 is depicted as arranged in fluid communication with the inner cavity 22 via an optional flexible adaptor ring 32 to communicate air through from the room through the grille 18 and into the inner cavity 22 in an aerodynamically efficient manner. The main housing inlet 28 is depicted as an entire rectangular side of the main housing 14, but could alternatively be only an aperture the size and shape of the flexible adaptor ring 32. The grille 18 illustratively comprises a top plate 34 and bottom plate 36, and means for reducing sound 20 arranged between the plates 34, 36 to attenuate sound. As discussed in additional detail herein, as air flows through the grille 18, the means for reducing sound 20 can attenuate sound created by operation of the ventilation assembly 12.

Figure 3:
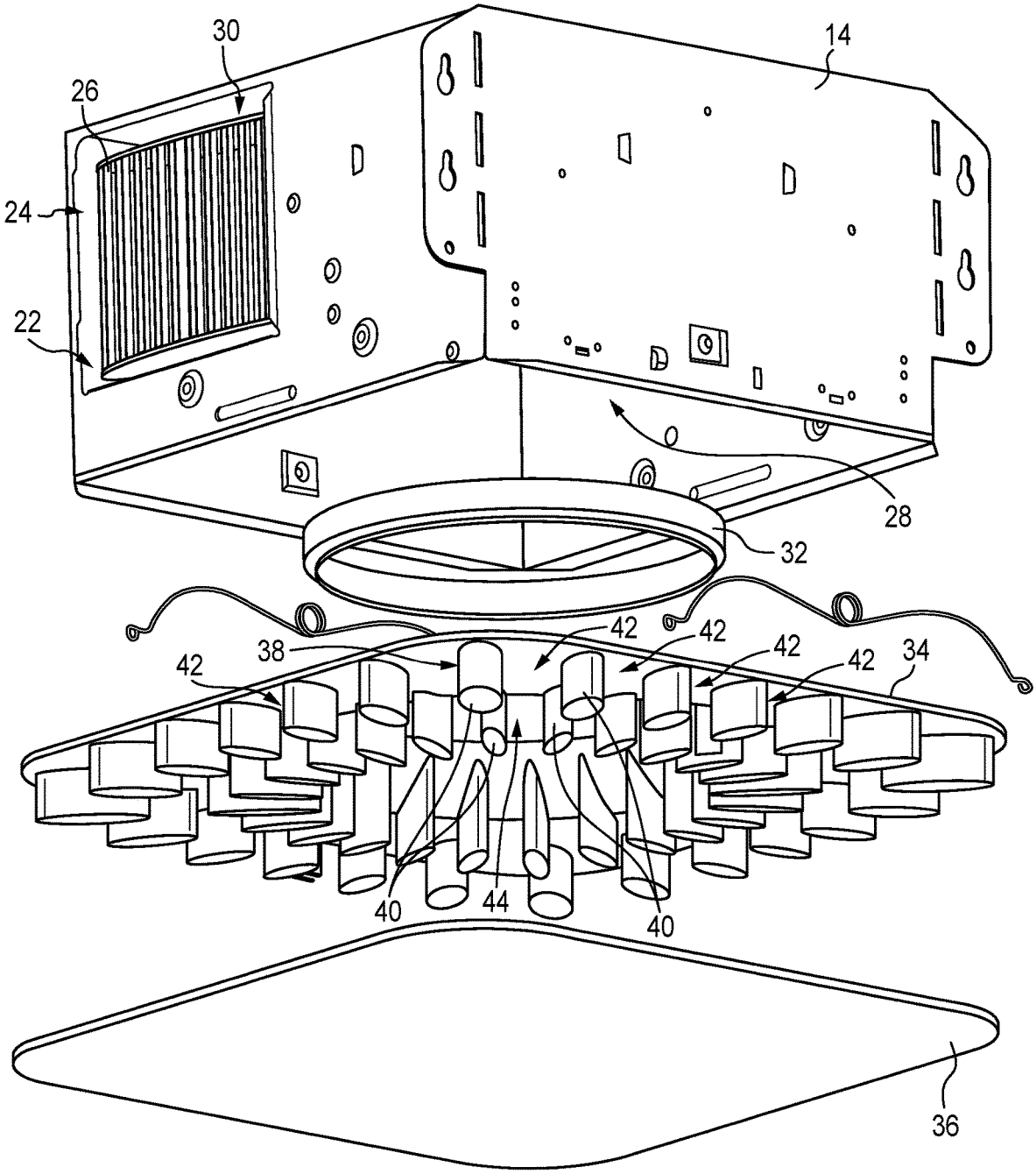
FIG. 3 is an exploded perspective view of the ventilation assembly of FIG. 2.

Referring to FIG. 3, the means for reducing sound 20 comprises a number of acoustic features 38 arranged to attenuate sound. Each acoustic feature 38 comprises a set of acoustic bodies 40, each set of acoustic bodies 40, which each acoustic feature 38, are collectively arranged to form a phononic crystal to attenuate sound, as discussed in additional detail herein. Adjacent acoustic features 38 are spaced apart from each other to define an air flow pathway 42 therebetween, which is bounded by the top and bottom plates 34, 36, where present. Both plates 34, 36 are not, however, required in all embodiments. Air is received from the room through the grille 18 at the outer perimeters of the top and bottom plates 34, 36, then travels through the airflow pathways 42 and then out of the grille 18 through an outlet aperture 44 defined in the top plate 24 and into the main housing 14. As discussed above, the air may optionally travel through a flexible adaptor ring 32.

Figure 4:
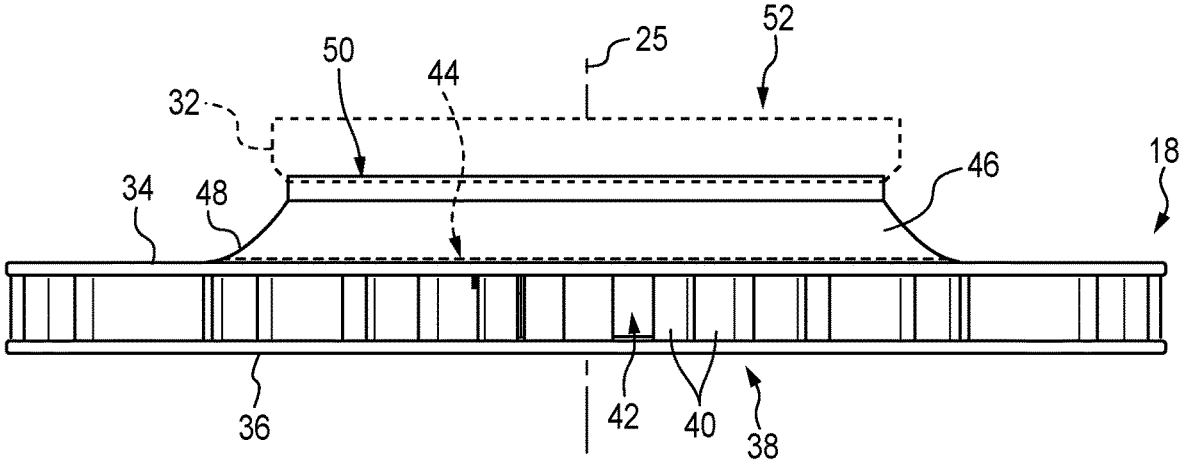
FIG. 4 is a side elevation view of the grille of the ventilation assembly of FIG. 2.
Figure 5:
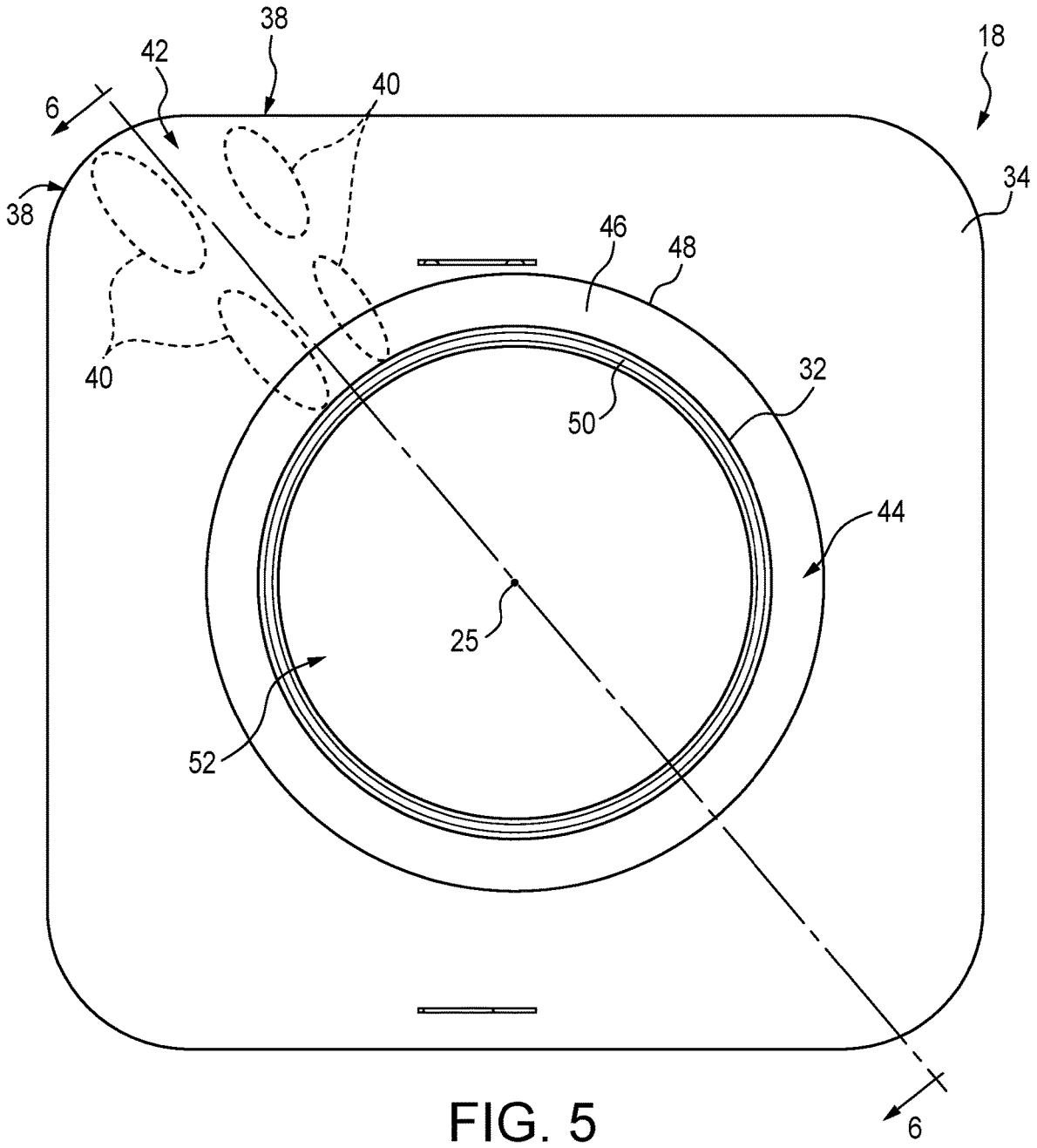
FIG. 5 is a top plan view of the grille of the ventilation assembly of FIG. 4 showing a first plate of the grille comprises an outlet aperture.

Referring now to FIGS. 4 and 5, the top plate 34 illustratively defines the outlet aperture 44. The grille 18 defines a collar 46 extending upwardly from the top plate 34 for connection with the adaptor ring 32 to fluidly communicate the outlet aperture 44 with the inner cavity 22 of the main housing 14. The collar 46 is illustratively formed hollow to communicate with the outlet aperture 44 on a first end 48 and with the adaptor ring 32 on the opposite, second end 50. The collar 46 and the adaptor ring 32 collectively define a flow passage 52 communicating between the outlet aperture 44 and the adaptor ring 32.

Figure 6:
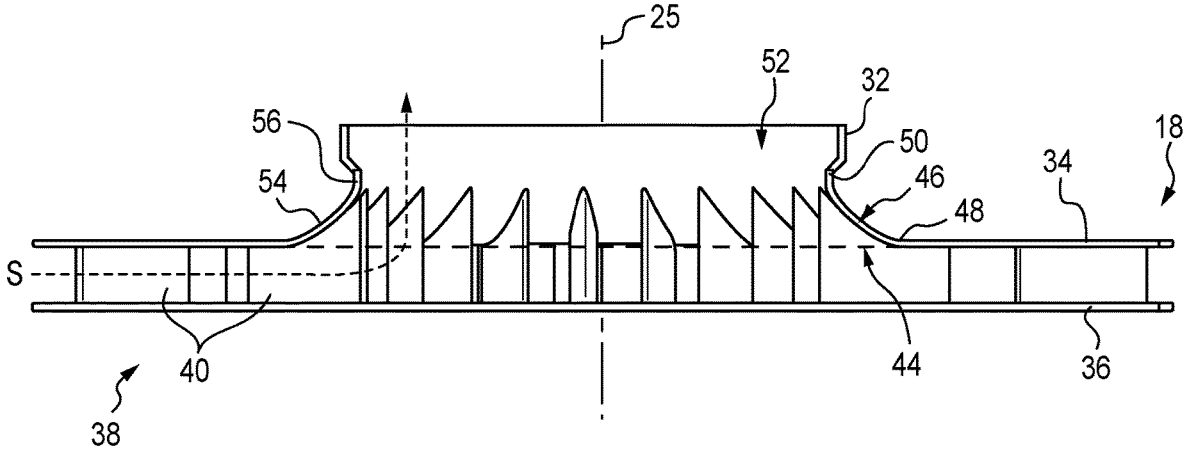
FIG. 6 is cross-sectional view of the grille of the ventilation assembly of FIG. 5 taken along the line 6F-6.

In FIG. 6, the collar 46 is illustratively formed to define a torus section 54 extending from the plate 34 at the collar first end 48 and a mating section 56 extending from the torus section 54 to define the second end 50 for engagement with the adaptor ring 32. The adaptor ring 32 can be separate from the collar 46 and secured thereto by any known means (e.g. force fit, adhesive, sonic weld, etc.) or the adaptor ring 32 can be integral with the collar 46.

The collar 46 defines a manifold transition section between the grille 18 and the ventilation assembly main housing 14 to provide smooth aerodynamic transition there between. In particular, the collar 46 extends from the top plate 34 toward the fan 26 to direct fluid flow toward the fan 46 and preventing fluid flow from greater access to the main housing inner cavity 22 which can redirect the fluid flow and/or create unwanted turbulence in the fluid flow, thereby lowering the efficiency of the ventilation assembly 12. Stated differently, the collar 46 directs the fluid flow from the top plate 34 toward the fan 24 in an aerodynamically efficient manner. The collar 46 can be configured so that the collar second end 50 approximately reaches the fan 24 upon installation. Alternatively, the collar second end can be spaced from the fan 24. The optional adaptor ring 32 can provide additional length to the collar 46 to lengthen the control of the fluid flow into the main housing 14 and toward the fan 24. In some embodiments, the collar second end 50 and/or the optional adaptor ring 32 can be sized to approximate the inlet of the fan 24 to deliver the fluid flow from the top plate 34 to the fan 24.

Figure 7:
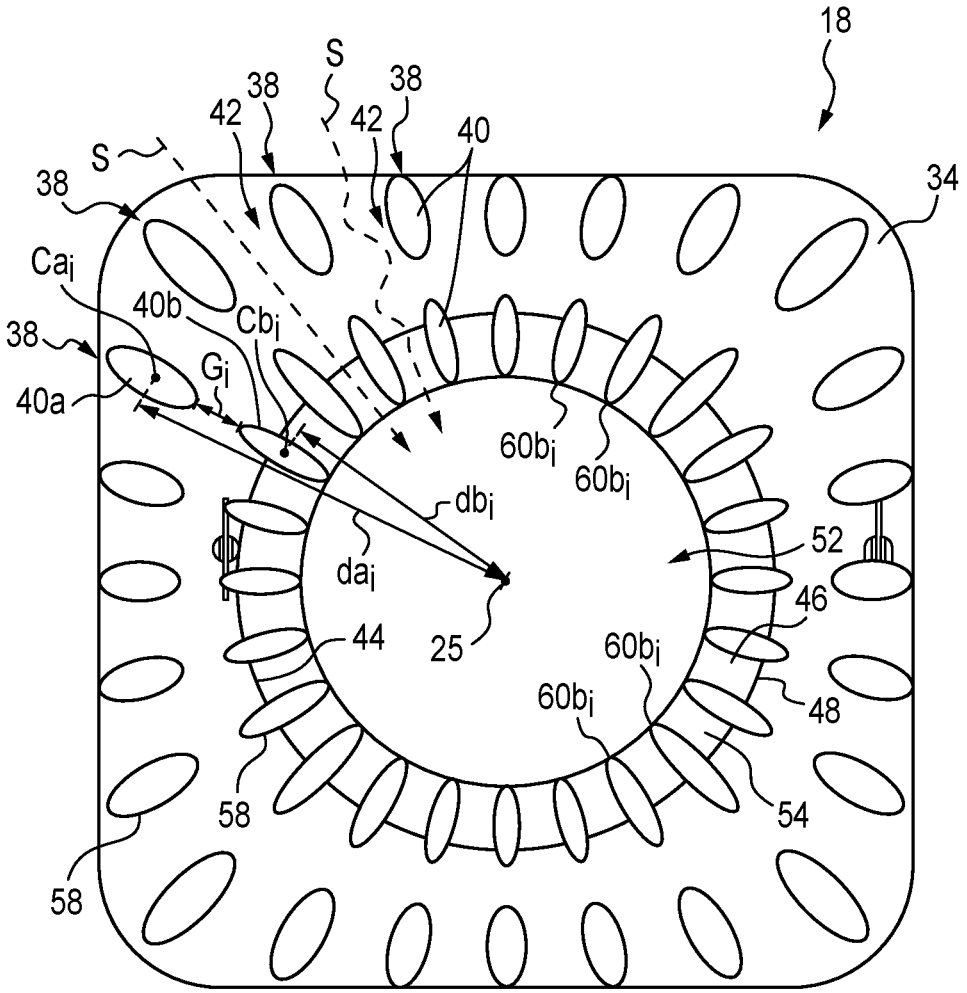
FIG. 7 is a bottom plan view of the first plate of the grille of the ventilation assembly of FIG. 5 showing a plurality of acoustic bodies arranged annularly around the outlet aperture.
Figure 8:
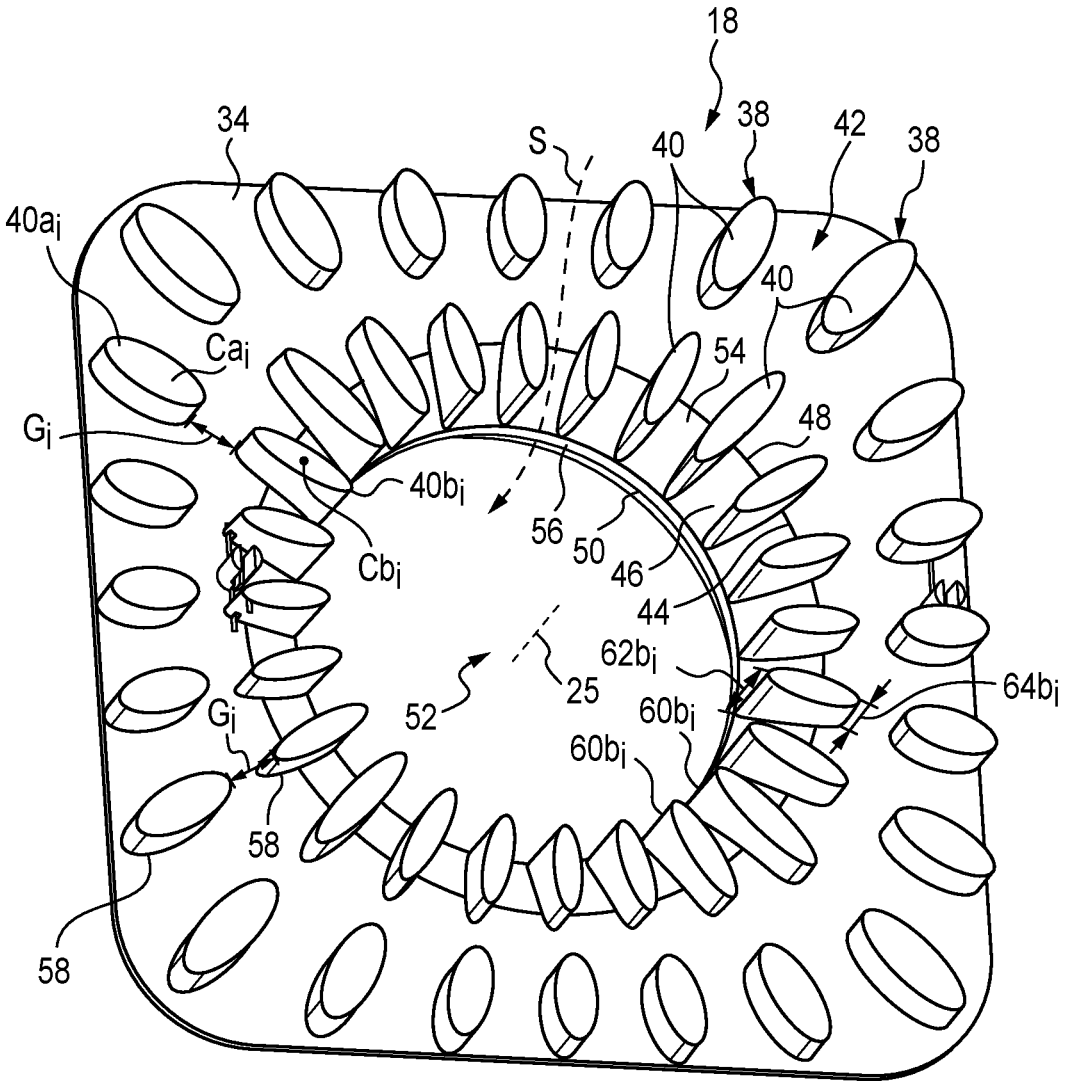
FIG. 8 is the perspective view of the bottom of the first plate of the grille of the ventilation assembly of FIG. 7 showing depth of the acoustic bodies.

FIGS. 7 and 8 depict an exemplary arrangement of the acoustic features 38 illustratively includes a pair of acoustic bodies 40, including outer acoustic body 40*a* and inner acoustic body 40*b*, although in some embodiments, the acoustic features 38 may include any suitable number of acoustic bodies 40 in forming phononic crystals. For example, an acoustic feature 38 may include three, four or more radially spaced acoustic bodies 40. Thus, the terms "inner" and "outer" when applied to acoustic bodies 40 are relative and are not to be interpreted as "innermost" and "outermost" unless context dictates otherwise. The outer acoustic bodies 40*a* are arranged annularly around the outlet aperture 44, and the inner acoustic bodies 40*b* are also arranged annularly around the outlet aperture 44, with the inner and outer acoustic bodies 40*b,a* aligned along the same radius. Each outer acoustic body 40*a* is arranged at a radial distance $da_i$ (e.g., $da_{1-n}$ for example of 1 through n acoustic features 38) between its centroid $Ca_i$ and a center axis 25 of the outlet aperture 44 that is greater than the radial distance $db_i$ (e.g., $db_{1-n}$ for example of 1 through n acoustic features 38) between the centroid $Cb_i$ of the corresponding inner acoustic body 40*b* of the same acoustic feature 38 and the center axis 25.

Each acoustic body 40 includes an outer perimeter 58 defining smooth aerodynamic shape, illustrated as approximating an ellipse, although in some embodiments, any suitable shape may be applied to each acoustic body 40. The inner and outer acoustic bodies 40*a*, 40*b* of each acoustic feature 38 are radially spaced apart from each other to define a gap $G_i$ between their outer perimeters 58. Each acoustic body 40 is arranged to extend longitudinally along the radial direction relative to the outlet aperture 44.

In the example embodiment of FIG. 7, the most radially inward portion $60b_i$ of each inner acoustic body 40*b* is coincident with the collar 46, and namely with in the mating section 56 of the collar 46. Alternatively, the most radially inward portion $60b_i$ may be spaced from the collar and the outlet aperture 44. In other alternative embodiments in which the grille 18 has no collar 46, the inner acoustic bodies 40*b* can be located on the top plate 34 and the most radially inward portion $60b_i$ can be coincident with the outlet aperture 44. In the embodiment depicted in FIG. 8, the most radially inward portion $60b_i$ of each inner acoustic body 40*b* defines a height $62b_i$ extending for connection with the inner surface of the collar 46, the height $62b_i$ being larger than a height $64b_i$ of the most radially outer portion of the inner acoustic body 40*b* due to the inwardly curved section 54 of collar 46. In alternative embodiments, the acoustic bodies 40 are of uniform height and are placed on a flat portion of the plates 34, 36. In the illustrative embodiment, the acoustic bodies 40 are formed as extruded-2-dimensional shapes having uniform dimensions of their outer perimeter 58 along their height, but in some embodiments, each acoustic body 40 may have curvature along its height.

Figure 9:
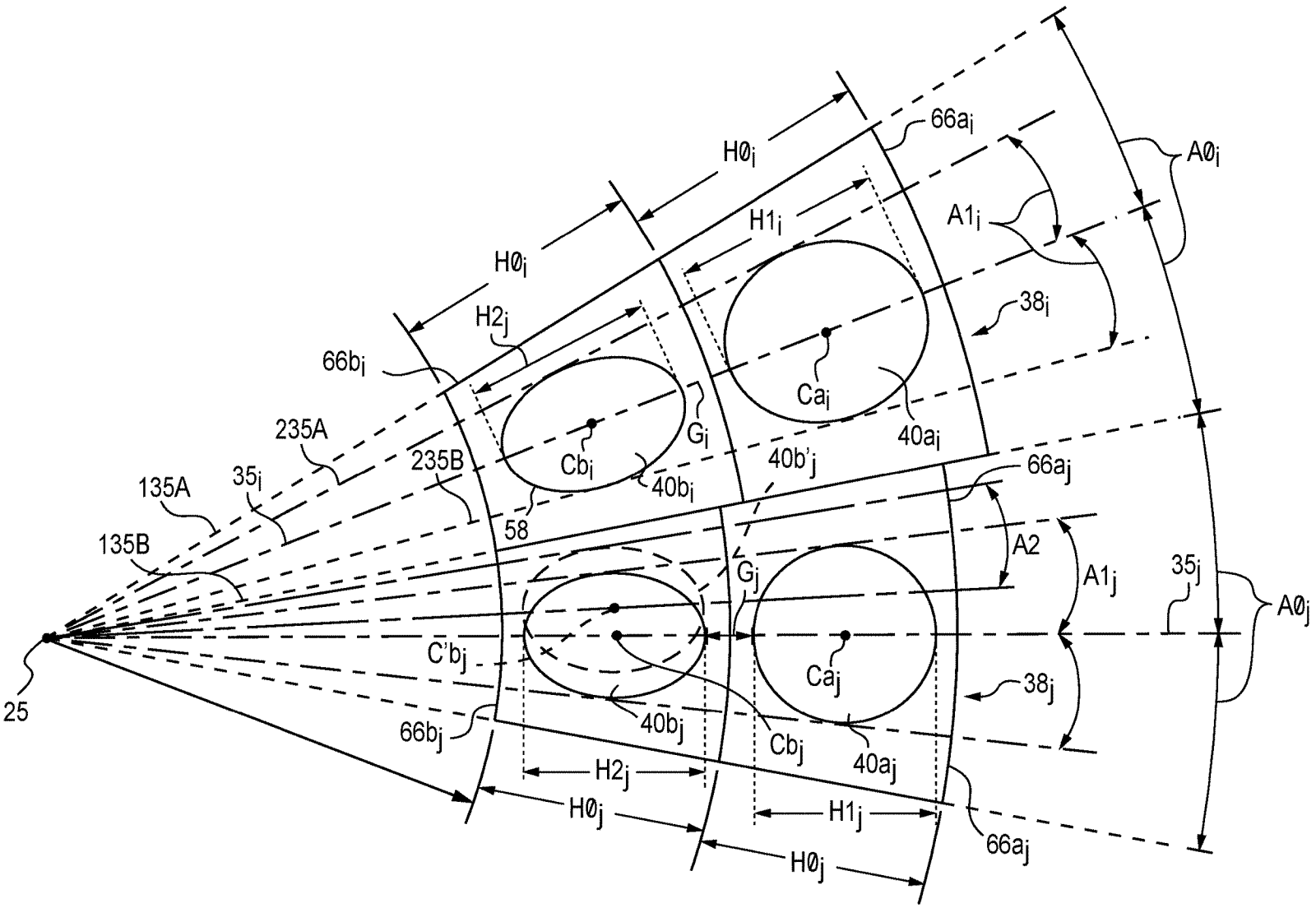
FIG. 9 is a diagrammatic view indicating an arrangement of the acoustic bodies of FIG. 8.

Referring now to FIG. 9, arrangements of the acoustic bodies 40 of individual acoustic features 38, and of the collective acoustic features 38 are discussed in terms of exemplary acoustic features $38_i$ and $38_j$ arranged adjacent one another. In particularly, each acoustic body 40 is configured according to a corresponding elementary cell $66x_{i,j}$ (e.g., $66a_{1-n}$, $66b_{1-n}$). Each elementary cell 66 can assist in defining the dimensions of the corresponding acoustic body 40, the relative positions between inner and outer acoustic bodies 40*a*, 40*b* of the same acoustic feature 38, and/or the open space between adjacent acoustic bodies 40, as discussed herein.

For example, in the annular arrangements of the acoustic bodies 40 of the illustrative embodiments, the centroids Ca, Cb of the acoustic bodies 40*a*, 40*b* are arranged co-linear on their corresponding center lines $35_{i,j}$. The lateral boundaries, and thus the width, of the elementary cells 66 are defined by the lines 135A, 135B, which are themselves defined at an angle A0 relative to their corresponding center lines $35_{i,j}$. The dimensions of the acoustic bodies 40 can be defined in terms of the parameters of their elementary cells 66. For example, the width of the acoustic bodies 40*a*, 40*b* of each acoustic feature 38 are defined such that the outer perimeter 58 of the outer and inner acoustic bodies 40*a*, 40*b* are respectively tangential to lines 235A, $235B_i$ that are defined at an angle A1 relative to their corresponding center lines $35_{i,j}$. An angular ratio of the acoustic body 40 and its elementary cell 66 can be defined as A1/A0.

The longitudinal (radial) thickness of each cell 66 is defined as H0. The longitudinal (radial) thickness of each acoustic body 40 is indicated as H1. A thickness ratio of the acoustic body 40 and its elementary cell 66 can be defined as H1/H0.

The thickness H0 of the elementary cells 66*a*, 66*b* is illustratively defined to fix the center of the frequency bandgap for attenuation, according to the relationship k*H0=π, where k is the angular wavenumber in the surrounding fluid (e.g., air). The center of the frequency band can be defined accordingly to the relationship $$f = \frac{c}{2 * H0},$$

where c is the speed of sound in the surrounding fluid (e.g., air). The width of the frequency band gap and the sound attenuation level are linked to the filling ratio r of the acoustic body 40 to its elementary cell 66, according to the relationship $$r = \frac{Sc}{Se},$$

where $S_c$ is 2-dimensional area defined by the perimeter 58 of the acoustic body 40, and $S_e$ is the 2-dimensional area defined by the elementary cell 66. The filing ratio r is related to each of the angular ratio A1/A0 and the thickness ratio H1/H0.

The acoustic bodies 40 can be made of any known material and provides the best performance with made of materials of high acoustical impedance. The acoustic bodies 40 may be solid or hollow. In one example, hollow acoustic bodies 40 may be used as Helmholtz resonators to dampen some frequencies. A solid acoustic body 40 could comprise an outer shell filled with any material. In one example, an acoustic body 40 could comprise a shell filled with a sound reducing material. One or more of the acoustic bodies 40 may be integrally formed as part of the upper plate 34 or the lower plate 36 or both 34, 36. Alternatively, one or more of the acoustic bodies 40 may be formed separate from the upper plate 34 and the lower plate 36 and affixed to one of the upper plate 34 or the lower plate 36 or both 34, 36 in any known manner consistent with this disclosure (e.g. adhesive, sonic welding, etc.). The acoustic bodies 40 may be manufactured by any known process (e.g. injection molding).

Figure 10:
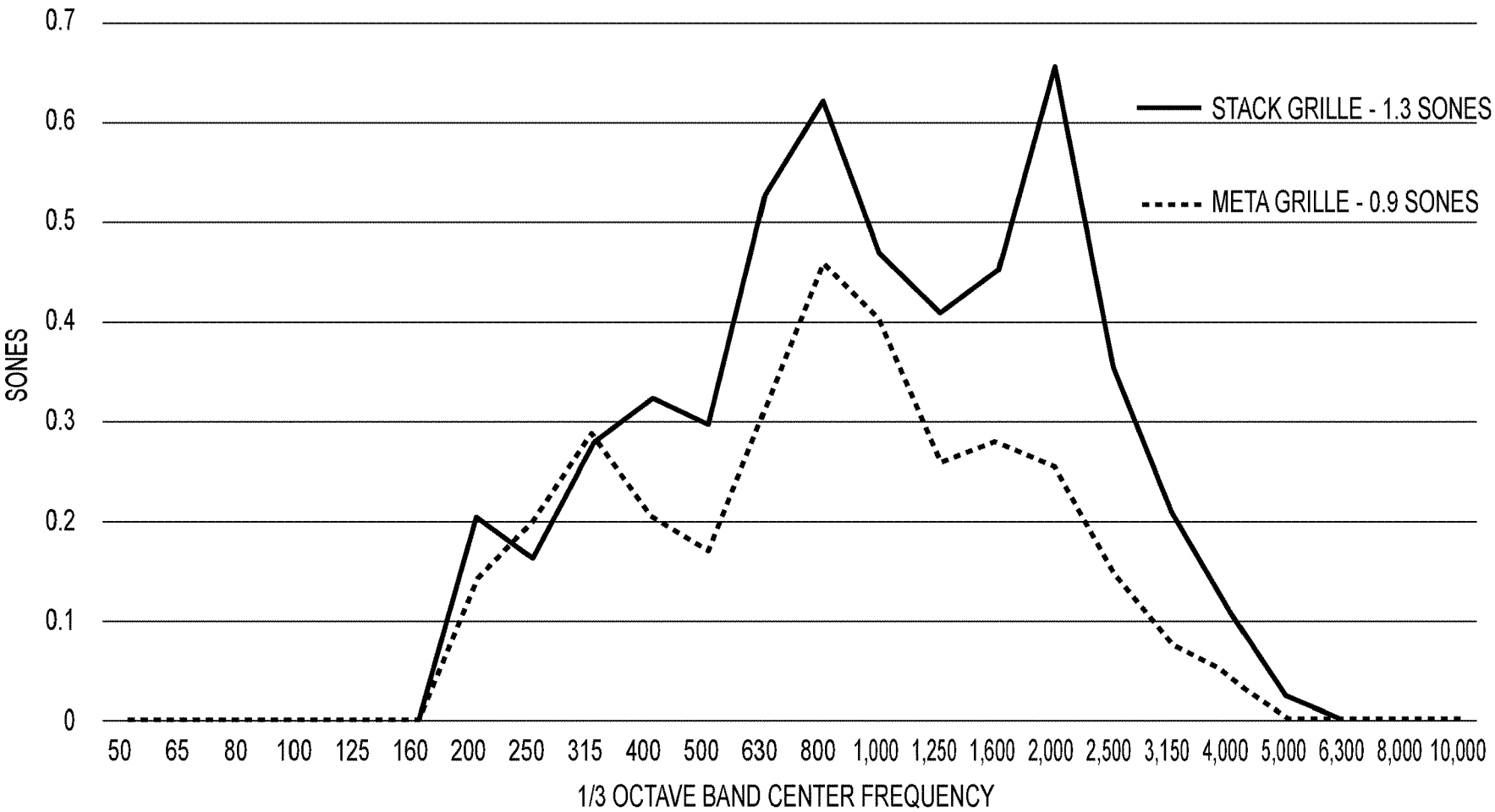
FIG. 10 is a graphical representation of the sound attenuation benefits of the present disclosure.

Based on common conditions for bathroom ventilation applications, exemplary ranges of values can be determined for defining the arrangements of the acoustic features 38. For example, exemplary values can be determined for a frequency band of about 200 to about 4000 Hz defined by a ⅓ octave band center frequency as shown in FIG. 10. Exemplary values for such given conditions can include angular ratios within the range of about 0.3 to about 0.5 and/or thickness ratios within the range of about 0.6 to about 0.8. Exemplary values for the angle of A0 can include A0 within the range of about 5 degrees to about 10 degrees from centerline 35.

Returning to FIG. 9, with reference to the acoustic feature $38_j$, the inner acoustic bodies 40*b* are illustratively centered on their corresponding center line 35 together with the outer acoustic body 40*a*. However, in some embodiments, the inner acoustic bodies 40*b* may be arranged off-center from their corresponding center line $35_{i,j}$ such that their centroid C is spaced apart from the corresponding center line $35_{i,j}$. For example, as shown in FIG. 9, the alternative inner acoustic body $40b'_j$ is arranged slightly off-center from the center line 35*j*, such that the centroid $Cb'_j$ is arranged on a line $45_j$ which defines an angle $A2_j$ from center line $35_j$. Exemplary values for the angle A2 for given conditions can include A2 being no greater than about 1/10th of A0.

The discussion of arrangements of the acoustic bodies 40 applies generically to each acoustic body 40 of a given acoustic feature 38, yet the acoustic features 38 may be arranged differently from other acoustic features 38 according to the concepts discussed above, for example, according to the particular conditions, physical parameters (configuration of moving parts of the ventilation assembly, geometries of the grille, etc.) and/or other internal and/or external factors. Adjacent acoustic features, such as acoustic features $38_{i,j}$ may differ in their arrangements but with preferred relationships there between, for example, to maintain overall circularity for the annular arrangements of the illustrative embodiments. Exemplary relationships can include variation of angles $A0_i$ and $A0_j$ of adjacent acoustic fixtures $38_{i,j}$ relative to each other within the range of about 1/1.2 to about 1.2. Exemplary relationships can include variation in the thicknesses $H0_i$ and $H0_j$ of adjacent acoustic fixtures $38_{i,j}$ relative to each other within the range of about 1/1.2 to about 1.2.

Referring to FIG. 10, a comparison is shown of the sound levels of an example ventilation assembly operating with a Stack Grille with the sound levels of the example ventilation assembly operating with the grille 18 according to the present disclosure (indicated as Meta Grille). Within the target ⅓ octaves (⅓ octave center band frequencies from 160 Hz to 6300 Hz) the level of sones from the Meta Grille were significantly reduced compared to the Stack Grille. A grille according to the description herein, including the example Meta Grille, with or without structural alterations within this disclosure, would reduce the level of sones in other frequency bands as well.

It should be noted that the various components and features described above can be combined in a variety of ways, so as to provide other non-illustrated embodiments within the scope of the disclosure. As such, it is to be understood that the disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation.

Although the present disclosure has been described in the foregoing description by way of illustrative embodiments thereof, these embodiments can be modified at will, without departing from the spirit, scope, and nature of the subject disclosed.

We claim:

1. A ventilation assembly comprising:

a main housing defining an inlet through which air can be received into the main housing and defining an outlet;

a blower in the main housing and operable to generate a flow of air; and a grille configured to be located adjacent to the main housing inlet, the grille having a plurality of acoustic features to reduce sound generated by the blower, wherein each of the acoustic features comprises two or more acoustic bodies spaced apart from each other, wherein the acoustic bodies of at least one acoustic feature are cylindrical and at least one of the acoustic bodies of the at least one acoustic feature defines an outer perimeter that is not a circular cylinder.

2. The ventilation assembly of claim 1, wherein the plurality of acoustic features are arranged about a grille outlet aperture defined in the grille.

3. The ventilation assembly of claim 2, wherein adjacent acoustic features define air flow pathways in fluid communication with the grille outlet aperture.

4. The ventilation assembly of claim 2, wherein the acoustic bodies are radially spaced apart from each other.

5. The ventilation assembly of claim 4, wherein the outer perimeter of each of the acoustic bodies define smooth aerodynamic shape.

6. The ventilation assembly of claim 4, wherein the outer perimeter of each of the acoustic bodies defines a radial length, and each of the acoustic bodies of at least one of the acoustic fixtures have equal radial length.

7. The ventilation assembly of claim 4, wherein the acoustic bodies of each acoustic feature comprises an outer acoustic body and an inner acoustic body.

8. The ventilation assembly of claim 7, wherein the outer acoustic bodies are arranged annularly about the grille outlet aperture.

9. The ventilation assembly of claim 7, wherein the inner acoustic bodies are arranged annularly about the grille outlet aperture.

10. The ventilation assembly of claim 7, wherein the inner and outer acoustic bodies of each acoustic feature are arranged with corresponding circumferential position about the grille outlet aperture.

11. The ventilation assembly of claim 2, wherein the grille comprises a first plate defining the grille outlet aperture, the plurality of acoustic features extending from the first plate.

12. The ventilation assembly of claim 11, wherein the acoustic features each include at least two acoustic bodies situated to form a phononic crystal to attenuate sound.

13. The ventilation assembly of claim 12, wherein the phononic crystals are collectively configured to attenuate sound within the frequency bands of the ventilation assembly.

14. The ventilation assembly of claim 12, wherein the phononic crystals are collectively configured to attenuate sound within either the frequency bands within the range of 160 to 6,300 Hz or the frequency bands within the range of 20 Hz to 20 kHz.

15. A ventilation assembly comprising:

a main housing defining an inlet through which air can be received into the main housing and defining an outlet;

a blower situated in the main housing and operable to generate a flow of air and generating sound in a frequency range of 500-1,000 Hz; and a grille configured to be located adjacent to the inlet of the main housing, the grille comprising a first plate defining a grille outlet aperture;

a second plate spaced from the first plate;

a plurality of acoustic bodies arranged about the grille outlet aperture to reduce the sound generated by the blower, each acoustic body extending from one of the first plate and the second plate, wherein the plurality of acoustic bodies comprises at least a first acoustic body and a second acoustic body forming an acoustic feature configured to reduce sound generated by the blower, wherein the acoustic bodies of at least one acoustic feature are cylindrical and the first acoustic body is spaced less than one foot from the second acoustic body, wherein the acoustic bodies of the at least one acoustic feature are not Helmholz resonators.

16. The ventilation assembly of claim 15, the first acoustic body defining an outer perimeter that is not a circular cylinder.

17. The ventilation assembly of claim 15, at least one of the acoustic bodies extends between the first and second plate.

18. The ventilation assembly of claim 15, wherein at least one of the acoustic bodies extends between the first and second plate and connects to both the first and second plate.

19. The ventilation assembly of claim 15, wherein adjacent acoustic bodies define air flow pathways in fluid communication with the grille outlet aperture.

20. The ventilation assembly of claim 15, wherein the acoustic bodies comprise two or more acoustic bodies radially spaced apart from each other.

21. The ventilation assembly of claim 15, wherein the outer perimeter of each of the acoustic bodies defines a radial length, and each of the acoustic bodies of at least one of the acoustic features have equal radial length.

22. The ventilation assembly of claim 15, wherein the acoustic bodies comprise a plurality of outer acoustic bodies and a plurality of inner acoustic bodies.

23. The ventilation assembly of claim 22, wherein the outer acoustic bodies are arranged annularly about the grille outlet aperture.

24. The ventilation assembly of claim 22, wherein the inner acoustic bodies are arranged annularly about the grille outlet aperture.

25. The ventilation assembly of claim 22, wherein the outer acoustic bodies and the inner acoustic bodies define at least one phononic crystal to attenuate sound.

26. The ventilation assembly of claim 25, wherein the phononic crystals are collectively configured to attenuate sound within the frequency bands of the ventilation assembly.

27. The ventilation assembly of claim 15, wherein at least one of the plurality of acoustic bodies approximates an ellipse.

28. A ventilation grille configured for a ventilation assembly having a blower, the ventilation grille comprising:

a first plate defining a grille outlet aperture; and a first acoustic feature and a second acoustic feature, each of the first and second acoustic feature extending from the first plate and arranged about the grille outlet aperture to attenuate sound generated by the blower, wherein the first acoustic feature comprises two acoustic bodies spaced apart a first distance and the second acoustic feature comprises two acoustic bodies spaced apart a second distance that is different than the first distance.

29. The ventilation grille of claim 28, wherein at least one of the acoustic bodies of the ventilation grille defines an outer perimeter that is not a circular cylinder.

30. The ventilation grille of claim 28, wherein the sound attenuation does not require a Helmholz resonator.

* * * * *